US010434369B2

(12) United States Patent
Kennington

(10) Patent No.: US 10,434,369 B2
(45) Date of Patent: Oct. 8, 2019

(54) EXERCISE MACHINE

(71) Applicant: Brandon Kennington, Westlake Village, CA (US)

(72) Inventor: Brandon Kennington, Westlake Village, CA (US)

(73) Assignee: FLEXLINE FITNESS, INC., Westlake Village, CA (US)

( * ) Notice: Subject to any disclaimer, the term of this patent is extended or adjusted under 35 U.S.C. 154(b) by 165 days.

(21) Appl. No.: 15/320,242

(22) PCT Filed: Jun. 19, 2015

(86) PCT No.: PCT/US2015/036813
§ 371 (c)(1),
(2) Date: Dec. 19, 2016

(87) PCT Pub. No.: WO2015/196158
PCT Pub. Date: Dec. 23, 2015

(65) Prior Publication Data

US 2017/0246507 A1 Aug. 31, 2017

Related U.S. Application Data

(60) Provisional application No. 62/117,897, filed on Feb. 18, 2015, provisional application No. 62/014,660, filed on Jun. 19, 2014.

(51) Int. Cl.
*A63B 21/00* (2006.01)
*A63B 21/16* (2006.01)
(Continued)

(52) U.S. Cl.
CPC ..... *A63B 24/0087* (2013.01); *A63B 21/0087* (2013.01); *A63B 21/154* (2013.01);
(Continued)

(58) Field of Classification Search
CPC ..... A63B 21/15–159; A63B 21/008–0088
See application file for complete search history.

(56) References Cited

U.S. PATENT DOCUMENTS 2,474,060 A 6/1949 Mosher
3,387,843 A 6/1968 Chandler
(Continued)

FOREIGN PATENT DOCUMENTS

EP 2009292 12/2008
JP S50-008628 A 1/1975
(Continued)

OTHER PUBLICATIONS

"Peloton's hi-tech $2,000 spin bike really could change your life" Website (online). Apr. 26, 2016. Retrieved Aug. 29, 2018. Retrieved from the Internet:<URL: http://www.dailymail.eo.uk/sciencetech/article-3552959/The-hi-tech-2-000-spin-bike-really-chang e-life.html>; Figure 1, pp. 2,3.

*Primary Examiner* — Nyca T Nguyen
(74) *Attorney, Agent, or Firm* — Cislo & Thomas, LLP

(57) ABSTRACT

A system and method of using an exercise system having a resistance structure of handles connected to cables, which cables are connected to at least one pneumatic cylinder that creates resistance, wherein the resistance is adjusted by the user via actuators in the handles, so that the user does not need to release the handles to adjust the resistance. The system is typically supported by a frame to surround the user, and the pneumatic cylinder may be connected to an equalizing tank that may be housed within or integrated into the frame. The system may include a monitor to visually display system parameters and other information to the user. The system may calculate resistance and work done by the user by measuring piston displacement and speed, as well as using accelerometers or other devices integrated into the handles.

18 Claims, 11 Drawing Sheets

(51) Int. Cl.

| | |
|---|---|
| ***A63B 24/00*** | (2006.01) |
| ***A63B 21/068*** | (2006.01) |
| ***A63B 21/008*** | (2006.01) |
| ***A63B 71/06*** | (2006.01) |
| *A63B 23/12* | (2006.01) |
| *A63B 23/035* | (2006.01) |

(52) U.S. Cl.
CPC ..... *A63B 21/4035* (2015.10); *A63B 24/0062* (2013.01); *A63B 71/0619* (2013.01); *A63B 2220/30* (2013.01); *A63B 2220/40* (2013.01); *A63B 2220/51* (2013.01)

(56) References Cited

U.S. PATENT DOCUMENTS

| | | | | |
|---|---|---|---|---|
| 4,836,535 | A * | 6/1989 | Pearson | A63B 21/06 482/101 |
| 4,934,692 | A | 6/1990 | Owens | |
| 5,197,933 | A | 3/1993 | Waters | |
| 5,447,480 | A | 9/1995 | Fulks | |
| 5,803,880 | A | 9/1998 | Allen | |
| 5,910,070 | A | 6/1999 | Henry et al. | |
| 5,993,356 | A | 11/1999 | Houston et al. | |
| 6,165,110 | A * | 12/2000 | Gajda | A63B 21/06 482/102 |
| 6,312,363 | B1 | 11/2001 | Watterson et al. | |
| 6,447,430 | B1 | 9/2002 | Webb et al. | |
| 6,645,125 | B1 * | 11/2003 | Stearns | A63B 22/001 482/52 |
| 7,608,031 | B2 * | 10/2009 | Kerry | A63B 69/0057 482/140 |
| 7,651,442 | B2 | 1/2010 | Carlson | |
| 7,967,728 | B2 | 6/2011 | Zavadsky et al. | |
| 8,057,368 | B1 | 11/2011 | Lyszczarz | |
| 8,075,453 | B1 * | 12/2011 | Wilkinson | A63B 22/0005 482/51 |
| 8,246,524 | B2 | 8/2012 | Castillo | |
| 8,388,499 | B1 | 3/2013 | Rindfleisch | |
| 8,585,554 | B2 | 11/2013 | Shavit et al. | |
| 9,539,461 | B2 | 1/2017 | Ercanbrack | |
| 2004/0138033 | A1 | 7/2004 | Van Straaten et al. | |
| 2004/0176226 | A1 * | 9/2004 | Carlson | A63B 21/0083 482/112 |
| 2005/0239615 | A1 | 10/2005 | Keiser | |
| 2006/0100068 | A1 * | 5/2006 | Volmar | A63B 21/154 482/94 |
| 2007/0049470 | A1 | 3/2007 | Plyes | |
| 2007/0072748 | A1 * | 3/2007 | Lee | A63B 21/00072 482/93 |
| 2007/0129222 | A1 | 6/2007 | Kolomeir | |
| 2008/0287267 | A1 * | 11/2008 | Ellis | A63B 21/00076 482/54 |
| 2009/0093350 | A1 | 4/2009 | Jahns | |
| 2012/0015784 | A1 | 1/2012 | Reed | |
| 2013/0172153 | A1 | 7/2013 | Watterson et al. | |
| 2014/0066257 | A1 | 3/2014 | Shavit et al. | |
| 2014/0113779 | A1 * | 4/2014 | Loach | A63B 21/0004 482/115 |
| 2014/0287876 | A1 | 10/2014 | Etter et al. | |

FOREIGN PATENT DOCUMENTS

| | | | |
|---|---|---|---|
| JP | 2000-237364 | A | 9/2000 |
| WO | WO 86/06644 | | 11/1986 |
| WO | WO 97/00031 | | 1/1997 |
| WO | WO 2008/152627 | | 12/2008 |
| WO | WO2011115443 | | 9/2011 |
| WO | WO2015196158 | | 12/2015 |

* cited by examiner

EXERCISE MACHINE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This invention relates to exercise equipment and their method of use.

BACKGROUND

One of the goals of exercise facilities is to be able to accommodate as many customers as possible while maximizing the different types of exercises that can be performed in a given space. Unfortunately, most exercise devices tend to target specific muscle groups. Therefore, a variety of different exercise devices are required. Given the limited space in a gym or studio, this leaves a limited number of a particular type of exercise device for each customer. Therefore, if there are more customers than a particular piece of gym equipment, then the customers must wait in line until the other user is finished with the gym equipment. In some settings, an instructor would like a group of students to simultaneously perform the same exercises while staying in the same relative position during a class, which is not possible where the gym just has one or two machines that are used for a particular exercise.

Furthermore, a lot of different gym equipment tends to take up a large footprint on the gym floor, further reducing the number of such equipment that can be placed in the gym. In addition, when there is a lot of gym equipment, it can be daunting for some customers as to where to begin and how to use the equipment.

Therefore, there is still a need for an exercise system that is simplistic, efficient, and provides a versatility of types of exercises, and cats be used simultaneously in a group setting.

DISCLOSURE OF INVENTION

The present invention is directed to an exercise machine that as a wide variety of adjustments that can be tailored to the user while operating the machine, without removing the user's hands from the machine's exercise handles. In a preferred embodiment, the exercise machine creates resistance through compressed gas in at least one pneumatic cylinder, whose resistance is adjusted via valves that are operated by wireless or wired controls incorporated into the exercise handles of the machine, so the user never needs to remove his hands from the exercise handle to adjust the resistance. The resistance may be automatically calculated and set by locking the pneumatic cylinder and having the user pull on the handles, and the force is measured by a strain gauge to determine the appropriate resistance for the exercise. A microprocessor handles the inputs from the user-operated handles, and controls valves in the system to adjust the pressure to the pneumatic cylinder to the appropriate level. The battery-equipped handles preferably transmit signals via Bluetooth to the microprocessor, which microprocessor may be alternatively or exclusively controlled and/or monitored via a video screen at the exercise machine, which may be a touch screen that allows additional inputs and selections to the microprocessor to select complete workouts, individual exercises, resistance values, time, and other various parameters for the exercises.

The handles are connected to cables that are routed to a pneumatic cylinder. During an exercise, the pneumatic cylinder(s) maintain a constant level of pressure, and thus a constant resistance to the cables and handles, by releasing gas into a larger tank that is maintained at the desired pressure. In some embodiments, the air connection between the pneumatic cylinder and the tank is continuous and unimpeded. The tank acts as a larger reservoir to maintain a relatively constant pressure in the cylinder during its compression and extension. In a preferred embodiment, the "tank" is a structural component of exercise machine, comprising T-slot extruded aluminum, used as the overhead structure (i.e. the header) for the exercise machine, which may have at least one chamber that can be used as the "tank" to equalize the pressure in the pneumatic cylinder as the cylinder is being extended or compressed during an exercise. Alternatively, a separate tank could be used.

One object of the device is to allow a user to have individual control over the tension (resistance) of the machine without removing his or her hands from the exercise handles. Another object of the device is to create an exercise machine that uses gas pressure rather than eights or other resistance-creating apparatus, which can save room by locating the gas compressor outside the exercise area and not requiring space for bulky weights or long connections of cables to weights, but rather having an easy to run gas line from the compressor to the exercise machine. One gas compressor can supply compressed gas to a multitude of machines, allowing for a space-saving group exercise machine where every machine tailors the resistance to the individual, where each machine has an individual pneumatic cylinder. In a group setting where multiple machines are used, one processor could be used for each machine, or one central microprocessor could control them all. Another object of the device is to allow specialized exercises that are difficult to accomplish with weights, by allowing the user to resist the weight but extend the user's appendage until it is sufficiently extended, then releasing the resistance via the button on the handle and starting the exercise over again, which when done with weights is usually accomplished by having a second person lift the weights to allow the user to begin each repetition (these are often called "negatives" because they use negative resistance). Another object of this device is to allow a user to view a video screen to obtain information from and input information to a microprocessor that can control various aspects and parameters of the exercise machine.

MODES FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The present invention is directed towards an exercise system 100, and in particular, a group exercise system that minimizes the number of components required for an exercise system, while maximizing the amount of space available at a given station for performing the exercises. Specifically, the exercise system 100 elevates much of the components to free up floor space. In addition, due to the relatively simplistic frame design, the exercise system 100 is modular, allowing the exercise facility to easily add additional stations to the exercise system 100.

Figure 1A:
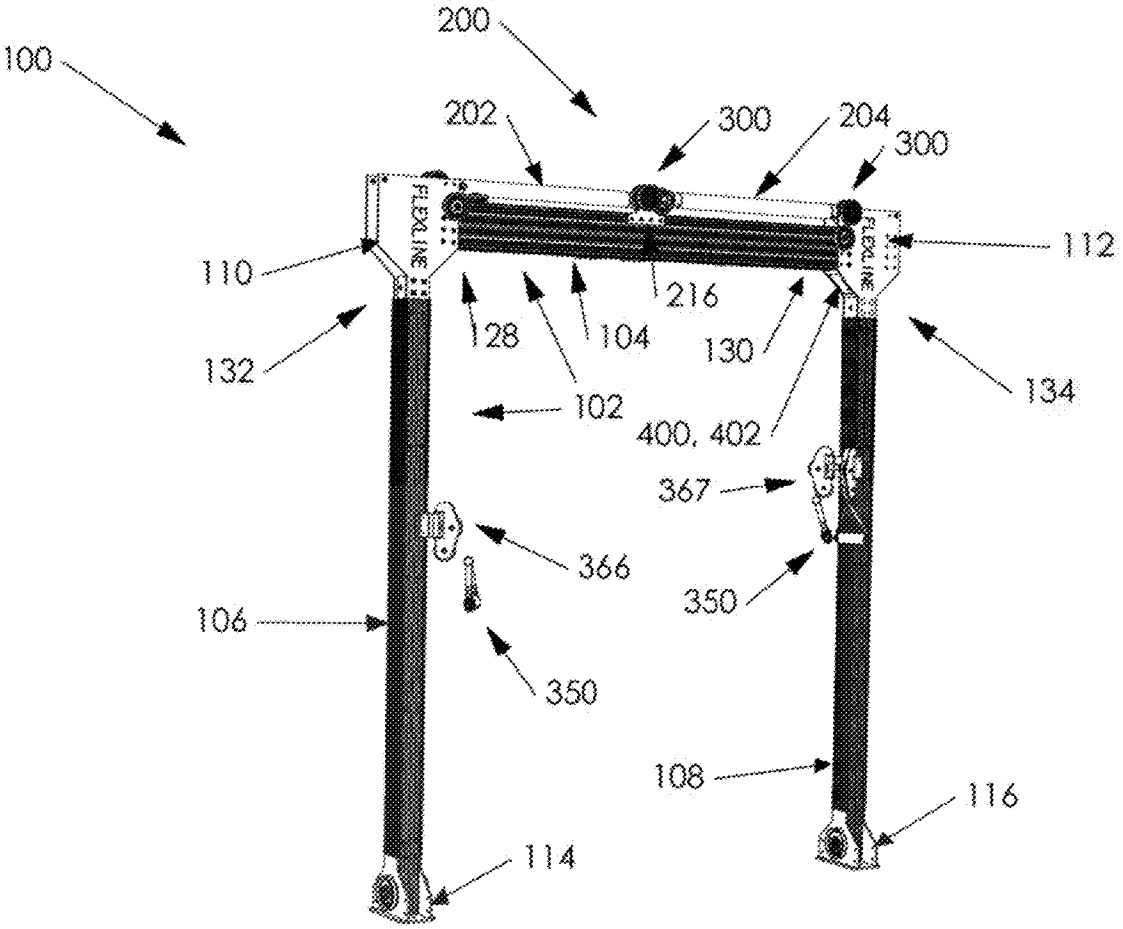
FIG. 1A is a perspective view of an embodiment of the present invention.
Figure 1B:
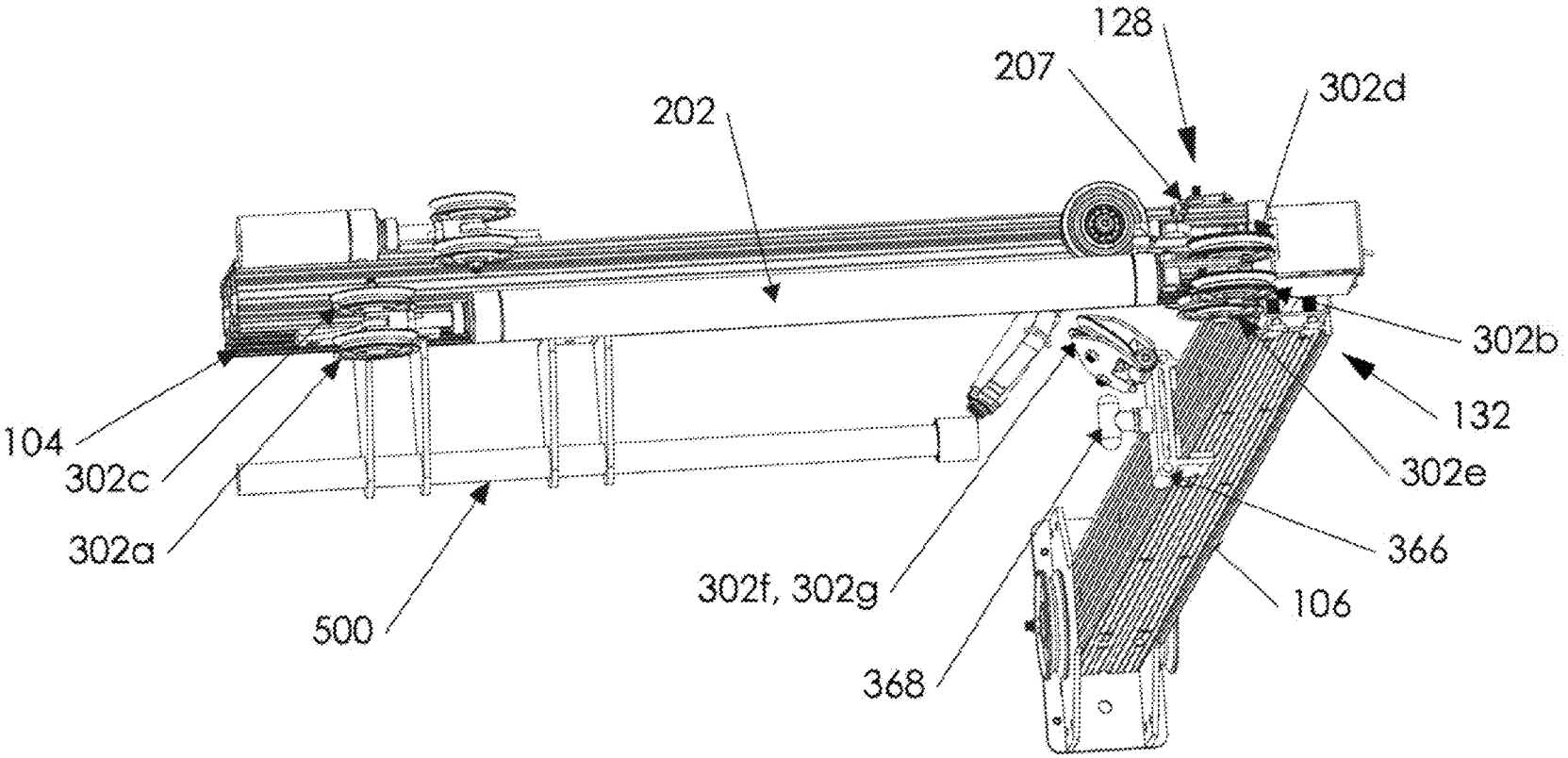
FIG. 1B is a perspective view from the top of an embodiment of the present invention with portions of the machine removed for clarity.

As shown in FIGS. 1A and 1B the exercise system 100 of the present invention comprises a frame 102, a resistance machine 200 mounted above the frame 102 (preferably a pneumatic cylinder), a pulley system 300 attached to the frame, and a controller 400 to control the amount of resistive force provided by the resistance machine 200. It is known that exercise systems have bilateral symmetry so that both sides may be exercised equally. For the sake of clarity, a component that may be presented in pairs or multiples, such as the handle 350, 352, pneumatic cylinders 202, 204, vertical frames 106, 108, and the like, may be described singly, but the description applies equally to both components in the pair.

The frame 102 comprises a horizontal frame 104 (or station header), and a pair of vertical frames 106, 108 (or slide-poles) attached to the horizontal frame 104 on opposite ends by a pair of corner plates 110, 112 (or crown plates), one corner plate attaching each end of the horizontal frame 104 to one of the vertical frames 106, 108. The frame 102 may further comprise a pair of base plates 114, 116 one base plate 114, 116 to secure each vertical frame 106, 108 to the floor.

Figure 2:
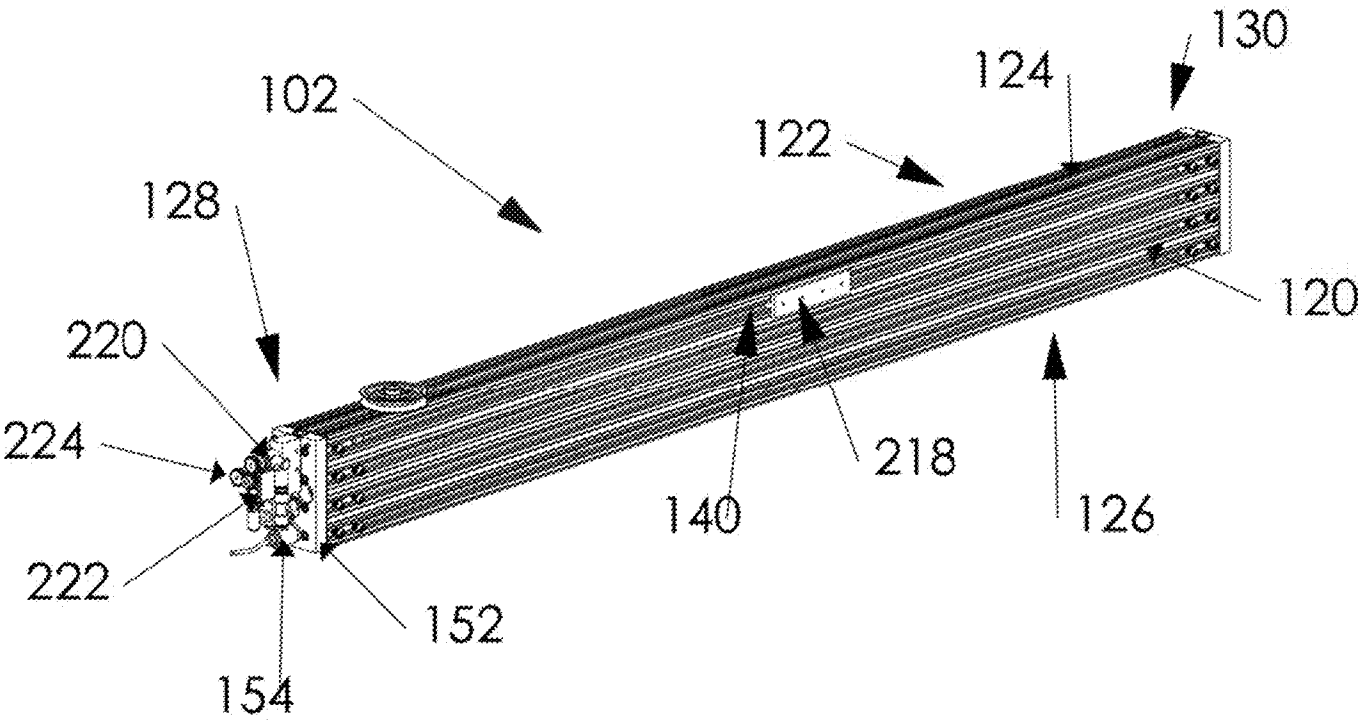
FIG. 2 is a perspective view of an embodiment of the horizontal frame.
Figure 3:
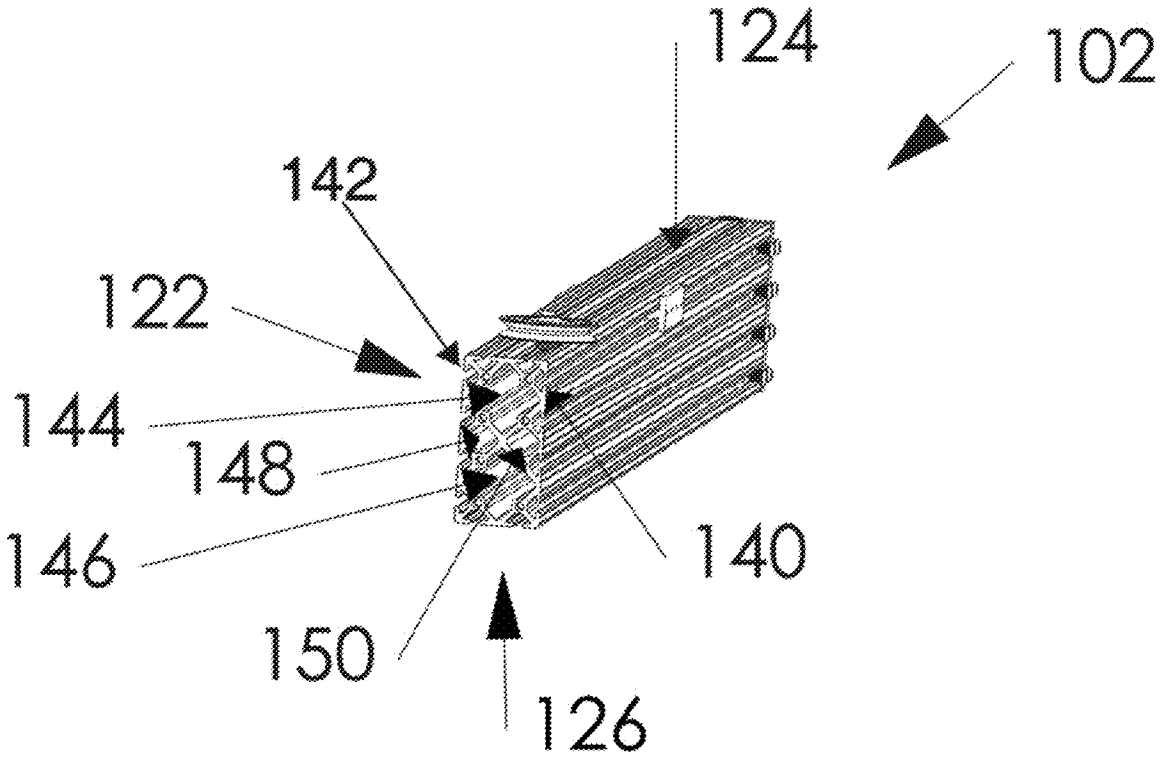
FIG. 3 shows a perspective view of the horizontal frame with components removed to show the cavities of the horizontal frame.

As shown in FIGS. 2 and 3, the horizontal frame 104 has a first side 120, a second side 122 opposite the first side 120, a top side 124 adjacent to the first side 120 and the second side 122, a bottom side 126 opposite the top side 124 and adjacent to the first side 120 and the second side 122, a first end 128 adjacent to the first side 120, the second side 122, the top side 124, and the bottom side 126, and a second end 130 opposite the first end 128 and adjacent to the first side 120, the second side 122, the top side 124, and the bottom side 126. The horizontal frame 104 may be mounted to the ceiling, to the walls, or to the ground by the vertical frames 106, 108, each vertical frame 106, 108 having a top end 132, 134 and a bottom end 136, 138.

In the preferred embodiment, the first end 128 of the horizontal frame 104 may be adjacent to the top end 132 of the first vertical frame 106, and the second end 130 of the horizontal frame may be adjacent to the top end 134 of the second vertical frame 108. The first side 120 of the horizontal frame 104 may comprise a first set of tracks 140, and the second side 122 may comprise a second set of tracks 142. The first side 120, second side 122, top side 124, and bottom side 126 may define one or more cavities 144, 146, 148, 150 extending substantially from the first end 128 of the horizontal frame 104 to the second end 130 of the horizontal frame 104. In some embodiments, the horizontal frame 104 defines two large cavities 144, 146 and two small cavities 148, 150 adjacent to the two large cavities 144, 146.

The cavities of the horizontal frame 104 are configured to house various components of the exercise system 100, such as the gas supply line and electrical cords. For better management of the components, the various components can be kept in separate cavities. For example, the gas supply line and the electrical cords may be housed in the separate small cavities 148, 150 of the horizontal frame 104, or in the same cavity. As discussed in more detail below, in embodiments in which the resistance machine is a pneumatic cylinder, one of the cavities 144, 146 may function as an equalizer tank in which the gas being compressed in the pneumatic cylinder can be released into the equalizer tank to maintain constant pressure in the pneumatic cylinder during an exercise.

Figure 4:
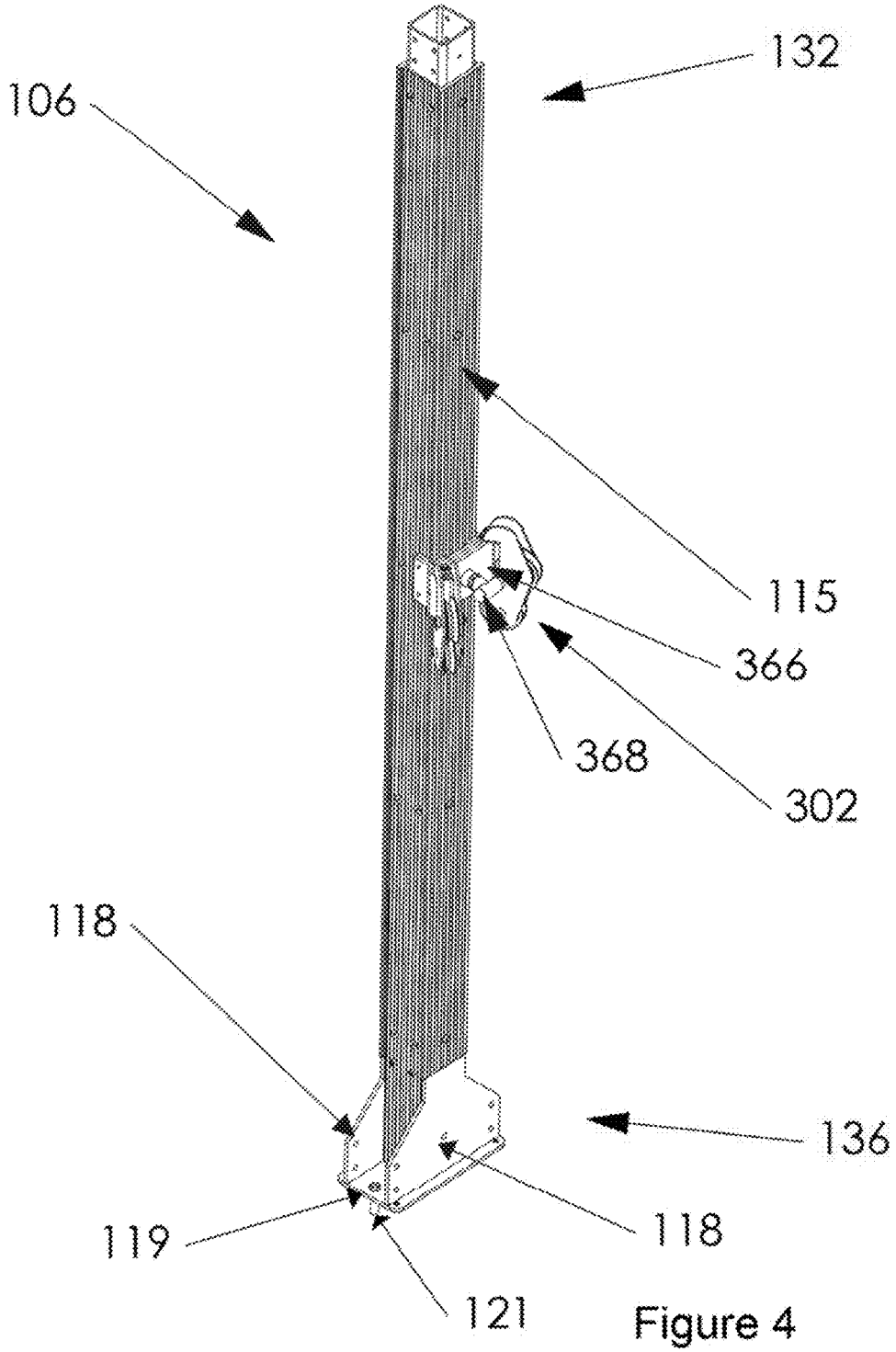
FIG. 4 shows a perspective view of an embodiment of the vertical frame.

As shown in FIG. 4, the vertical frame 106, 108 may also comprise a track 115 along which the handles can slide up and down to adjust the height of the handles. The vertical frames 106, 108 can be secured to the floor by base plates 114, 116. The base plates 114, 116 may each comprise a pair of opposing wall plates 118 to sandwich the vertical frame, and a bottom plate 119 having a post 121 to secure the vertical frame to the floor.

Figure 5:
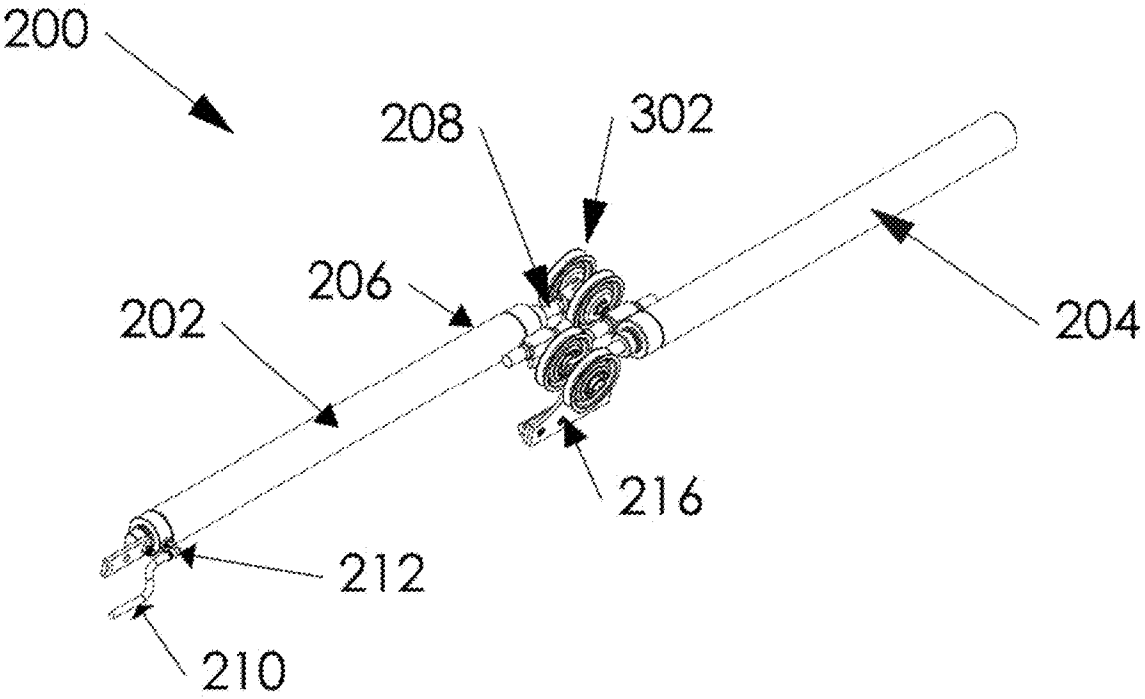
FIG. 5 shows a perspective view of an embodiment of the resistance machine.
Figure 6:
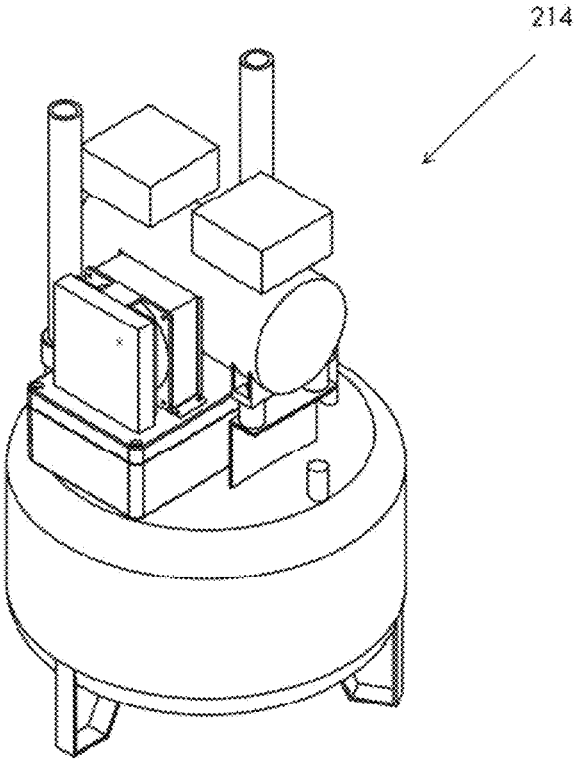
FIG. 6 shows a top view, perspective views, and elevation views of an embodiment of the compressor.

In the preferred embodiment, the resistance provided to the user during an exercise is created by pneumatic cylinders 202, 204. To maximize floor space, the pneumatic cylinders 202, 204 are preferably mounted above the horizontal frame 104. As shown in FIG. 5, each pneumatic cylinder 202, 204 comprises a gas tube 206, a piston 208 slidable within the gas tube 206 and a gas hose 210 attached to an access port 212 through which compressed air in the cylinder 202 flows in and out to the tank. A gas compressor 214 (shown in FIG. 6) is attached to the tank (e.g. cavity 144 or 146) of the horizontal frame 104 to provide compressed gas to the pneumatic cylinder 202. The access port 212 allows the compressed gas inside the pneumatic cylinder 202 to leak out into the equalizer tank (e.g. cavity 144 or 146) so that the piston 208 experiences a constant resistive force as the piston 208 is being driven into the gas tube 206 by the user during an exercise. As such, the cavities 144, 146 may be closed by pressure plates 152 to prevented unwanted gas leaks from the equalizer tank as shown in FIG. 2. A pressure sensor 154 may be provided to monitor the resistive force and adjust the amount of compressed air in the cylinder 202 to maintain the resistive force at the desired level. A valve system 220 may be operatively connected to the access port 212 to control the amount of gas input and released so as to maintain a constant pressure inside the pneumatic cylinders 202, 204. In a preferred embodiment, the valve system 220 comprises at least one needle valve that may be controlled by a servomotor 222 and gears 224. In some embodiments, the user and/or the microprocessor can change the rate that the gas is released from or fed into the tank by adjusting how far the intake valve or release valve is opened, which can be useful in changing resistance on the fly in the middle of an exercise.

The piston 208 is driven into the gas tube 206 by the user during an exercise by the pulley system 300. The pulley system 300 comprises a set of pulleys 302 and a drive mechanism (not shown). Preferably, the piston 208 is operatively connected to a piston slide plate 216 slidably mounted on the horizontal frame 104, for example, via one of the tracks 140 of the horizontal frame 104. Preferably, sliding members 218 can be inserted into the tracks 140. The piston slide plate 216 can be mounted to the sliding members 218 with standard fasteners. The sliding members 218 can be any type of mechanism that can slide along the track 140 with minimal resistance, For example, the sliding member 218 may comprise a smooth flat surface, rollers, ball bearings, and the like. Minimizing the friction between the sliding member 218 and the track 104 allows for a more accurate measurement of the resistive force created by the piston 208 being driven into the gas tube 206.

Referring back to FIGS. 1A and 1B, each gas tube 206 is operatively connected to one of the corner plates 110, 112 mounted on the horizontal frame 104. Preferably, corner plates 110, 112 may be used to connect the first end 128 of the horizontal frame 104 to the top end 132 of a first vertical frame 106 and the second end 130 of the horizontal frame 104 to the top end 134 of a second vertical frame 108. The gas tube 206 may be fixed to one of the corner plates 110, 112 while the piston 208 is mounted on the piston slide plate 216 to be able to slide along the horizontal frame 104. Movement of the piston slide plate 216 along the horizontal frame 104 allows for the piston 208 to move in and out of the gas tube 206. Pulleys 302*a-d* are attached to the piston slide plate 216 and the corner plate 110, 112. A drive mechanism (not shown) is operatively attached to the pulleys 302. As is known in the art, the drive mechanism may be a cable, chain, a rope, a belt, and the like. The drive mechanism may be wound through the pulley 302 terminating at two free ends. Each free end may be attached to a handle 350. In some embodiments, the drive mechanism may be wound through the pulley system 302 terminating at one free end attached to a handle 350 and a connected end attached to the frame 102. The pulley system 302 is configured such that when the user imparts a pulling force on the drive mechanism 304 by moving the handle 350 (e.g. pulling or pushing the handle), the piston 208 is driven into the gas tube 206 as the sliding bracket 216 moves towards the corner plate (e.g. 110) and the compressed gas inside the gas tube 206 provides the resistive force. The resistive force remains constant by dissipating the compressed gas into an equalizing tank (e.g. one or more of the large cavities 144, 146 of the horizontal frame 104). The large volume of the tank relative to the pneumatic cylinder keeps the pressure in the cylinder relatively constant when the piston 208 is compressed. When the pulling force is removed, the piston 208 returns back to its original position. In a system where a pneumatic cylinder 202 is provided for each drive mechanism, and an exercise station has two drive mechanisms, one for each arm or leg, each pneumatic cylinder 202 may be connected with a common tank, so that the pressures on each cylinder are equal. In embodiments where multiple stations are being used simultaneously, individual tanks may be used for each station to tailor the resistance to the individual user.

In the preferred embodiment, the gas tube 206 is approximately 2 feet (0.61 meters) long. Therefore, the piston 208 can travel a distance of approximately 2 feet. To assure that the user has sufficient length of the drive mechanism to perform the exercises, in the preferred embodiment, four pulleys 302*a-d* are attached to or near the pneumatic cylinder 202 to give a mechanical advantage of four. This allows the drive mechanism 304 to be moved four times the length of the gas tube 206. Therefore, with a two foot gas tube 206, the user can move the handle 350 attached to the drive mechanism eight feet (2.44 meters), which is usually sufficient for any type of exercise. In addition, the four-pulley embodiment decreases the resistance at the handle 350 at a 4:1 ratio compared to the pneumatic cylinder 202. For example, if the resistance at the pneumatic cylinder 202 is 100 Newtons, the resistance at the handle 350 is 25 Newtons. This reduction of resistance at the handle 350 allows for finer adjustment of the resistance at the handle 350. Other combinations of pulleys can be used to vary the velocity ratio and the mechanical advantage.

With reference to FIG. 1B, preferably, two of the pulleys 302*a*, 302*c* are attached to the piston slide plate 216, bilaterally arranged about the piston 208, and two pulleys 302*b*, 302*d* are attached to the corner plate 112, bilaterally arranged about the gas tube 206. A fifth pulley 302*e* may be positioned on the corner plate 112 just below one of the pulleys 302*b* attached to the corner plate 112 and adjacent to the gas tube 206. Attached to the handle slide bracket 366 is a pair of handle pulleys 302*f*, 302*g* associated with the handle 350. The handle 350 is attached to the drive mechanism which is fed in between the pair of handle pulleys 302*f*, 302*g*. Therefore, the handle 350 serves as a stop to prevent the drive mechanism from passing completely through the pair of handle pulleys 302*f*, 302*g*. From the handle pulleys 302*f*, 302*g*, the drive mechanism 304 rises up to the fifth pulley 302*e* which allows the drive mechanism to change directions towards one of the pulleys 302*a* on the piston slide plate 216. The drive mechanism wraps around the first pulley 302*a* on the piston slide plate 216, changes direction and extends towards the second pulley 302*b* located on the corner plate 112. The drive mechanism raps around the second pulley 302*b* and heads back towards the piston slide plate 216 and wraps around the third pulley 302*c*. The drive mechanism then heads back towards the fourth pulley 302*d* on the corner plate 216, Additional directional pulleys may be used to fix the end of the drive mechanism to a desired position on the frame 102. This setup can be repeated on the opposite side with the second handle.

In some embodiments, each pneumatic cylinder 202, 204 may have an infrared (IR) sensor 207 associated with it. The IR sensor 207 may be in-line with the piston 208 on the opposite side of the gas tube 206 housing the piston 208 with which the IR sensor 207 is in-line. This IR sensor 207 may be able to calculate movement or position of the piston 208, which may be by measuring the distance between the IR sensor 207 and the piston 208, By detecting movement of the piston 208 as a function of time, the rate or velocity of the piston movement can be determined. The talk may have a pressure sensor 154 to determine the amount of pressure in the pneumatic cylinder 202, 204. Knowing the velocity of the piston 208 and the pressure in the gas tube 206, the power being exerted by the user during an exercise can be calculated. This data can be used to optimize and customize a user's exercises, which can be important for high level athletes. Such data can also be used to summarize/analyze completed workouts and plan subsequent workouts.

In some embodiments, a single pneumatic cylinder 202 may be used as the resistive force for both handles 350. In such an embodiment, the drive mechanism may connect both handles 350 to the same pneumatic cylinder 202. If the user desires to use only one handle 350, the second handle can be locked against the frame. In some embodiments, each handle 350 may be attached to its own pneumatic cylinder 202, 204, which may be connected to a common tank or individual tanks. Therefore, each handle 350 may be attached to their own respective pulley system, drive mechanism, and pneumatic cylinder. This allows each handle to be independent of the other, especially if the pneumatic cylinders are connected to separate tanks.

The pair of handles 350 are operatively coupled to the drive mechanism; and therefore, operatively connected to the resistance machine. The resistance machine provides the resistive force to counter a pulling force on the drive mechanism by a user moving the handle.

Figure 7:
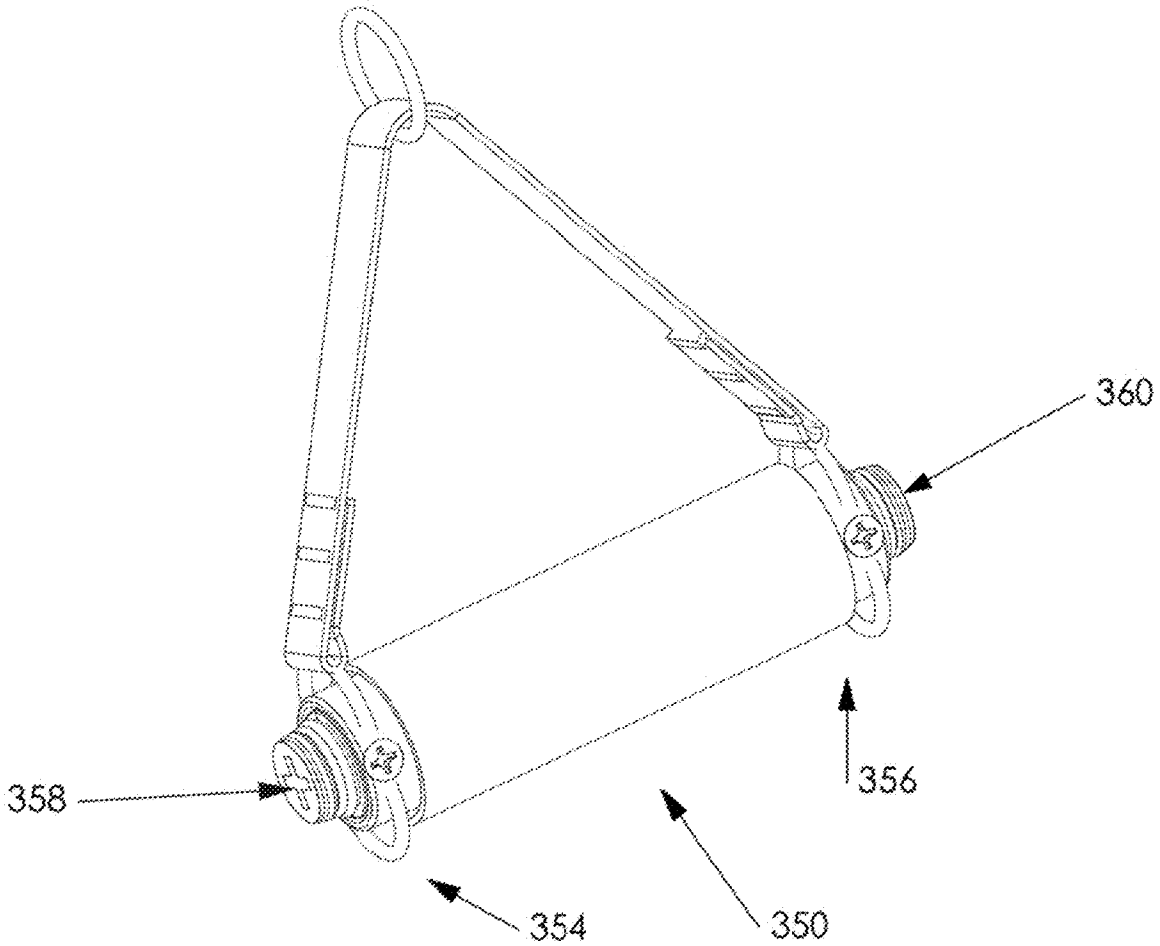
FIG. 7 shows a perspective view of an embodiment of the handle.
Figure 8:
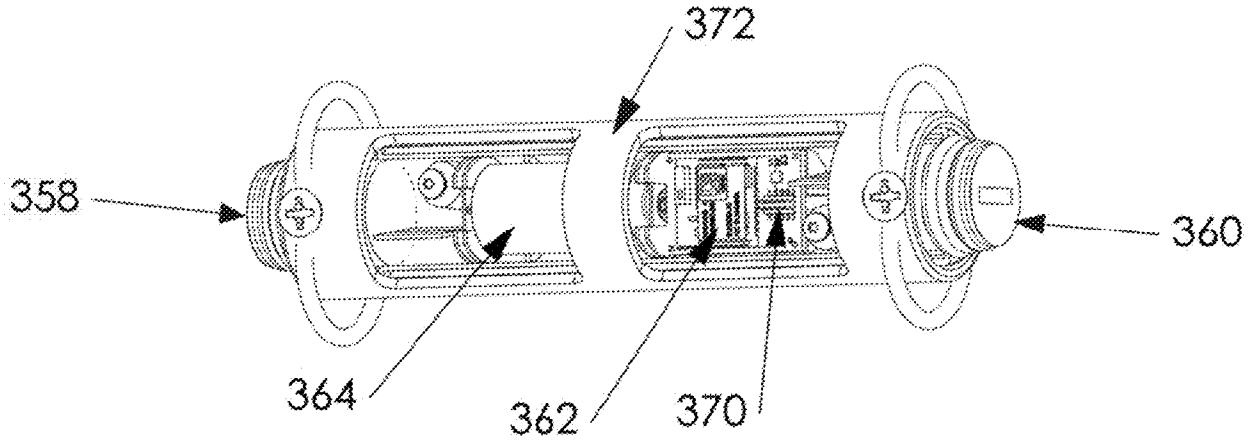
FIG. 8 shows a perspective view of an embodiment of the handle with portions removed to show the internal structures.

As shown in FIGS. 7 and 8, in the preferred embodiment, each handle 350 is cylindrical in shape having a first end 354 and a second end 356 opposite the first end. The first end 354 has a gas input actuator 358 and the second end 356 has a gas release actuator 360. The handles 350 are operatively connected to a controller 400 so that actuation of the gas input actuator 358 causes the gas compressor 214 to add compressed gas into the gas tube 206 and tank, and actuation of the gas release actuator 360 causes the valve s 220 to open so as to release the compressed gas from the gas tube 206 and tank to adjust the desired resistive force against the piston 208. The gas input actuator may operate a valve system 220 that opens a valve to allow the compressor to add air pressure to the gas tube 206 and tank. Since the handles 350 may be substantially cylindrical in shape, a natural grip on the handles 350 would place the thumbs of the user at one of the ends 354, 356 of the handle 350. Therefore, in one configuration, the user can grasp one handle 350 so that the thumb is adjacent to the gas input actuator 358. The second handle can be grasped in a second configuration in which the user's other thumb is adjacent to the gas release actuator 360. This grasping configuration allows the user to control the amount of resistive force without having to release the handles 350 or adjust the position of the user's hands on the handle 350 because the user can press and release either the gas input actuator 358 in one hand or the gas release actuator 360 in the other hand.

Other handle configurations can be used. For example, the gas input actuator 358 and the gas release actuator 360 may be located at the same end of the handle adjacent to each other. The user can grasp the handle so that the user's thumb is adjacent to the actuators. Then, the user can actuate either the gas input actuator or the gas release actuator with the same thumb.

With the actuators 358, 360 adjacent to the thumbs, the user is able to change the resistance in the middle of an exercise. In other words, the user can instantly add or release pressure in the middle of an exercise. For example, a user may be performing an exercise involving a concentric contraction. If the user is unable to complete the movement for a full contraction, the user can slowly start to release the pressure from the pneumatic cylinders by pressing the gas release actuator 360. As the resistance in the pneumatic cylinder 202, 204 decreases, the user is able to complete the contraction. As discussed above, the user may be able to control the rate of flow of gas, which may be adjusted by pressing harder on the button. Or the rate may be preset by the controller for a particular exercise, or calculated by controller based on various input parameters such as air pressure, rate of cylinder movement, acceleration of the handle, position of the handle, etc.

Similarly, the user can perform an eccentric contraction exercise by releasing the compressed gas from the pneumatic cylinders 202, 204, pulling the handle 350 until the piston 208 is fully inserted into the gas tube 206, then slowly increasing the compressed gas into the pneumatic cylinder 202, 204 by pressing the gas input actuator 358 causing the piston 208 to be moved out of the gas tube while the user resists this force.

The handles 350 may further comprise an accelerometer 362. An accelerometer 362 can perform a number of functions in the handle 350. First, the handle 350 may have a battery 364. Therefore, to save battery power, the electronic features of the handle can enter a sleep mode if the accelerometer does not detect any movement.

Using the accelerometer to detect a simple change in direction of movement of the handle 350 can be an indication of the completion of one repetition (rep) of an exercise. Therefore, the handles 350 can be used to keep track of the number of reps during a particular exercise. More complex algorithms can be written to determine the precise exercise being performed based on the overall movement and orientation of the handles 350 the speed of the handle, or to determine if an exercise is being performed correctly. Simulation of the movement can be replicated and displayed on a monitor 402. The proper movement of the exercise may be overlaid on the simulation so that the user can see whether his movements are correct or not. In addition to, or in place of an accelerometer, the handle could be equipped to work with a local or indoor positioning, or other suitable systems that can track the position and movement of the handle.

To vary the types of exercises that can be performed on the exercise system 100 of the present invention, the handles 350 may be adjustably connected to the frame. For example, the vertical frames 106, 108 may also comprise a track 115 similar to the horizontal frames 104. The handles 350 may be attached to the vertical frames 106, 108 via slide brackets 366, 367 with one handle 350 attached to one vertical frame 106, so that the handles can be vertically adjusted. Locks 368 may be provided on the slide brackets so that the handles 350 can be locked in position at a desired height.

The components of the handle, such as the electronics 370, batteries 364, buttons 358, 360, and accelerometer 362 may be compactly arranged as a cylindrical module in a handle cage 372 so that the module can be easily removed from the handle 350, 352 and inserted into a different type of exercise bar like changing a battery.

A controller 400 may be operatively connected to the gas input actuator 358, the gas release actuator 360, the valve system 220, and the gas compressor 214, so that actuation of the gas input actuator 358 causes the controller 400 to turn the gas compressor 214 on to increase gas pressure in the pneumatic cylinder 202, 204, and actuation of the gas release actuator 360 causes the pneumatic cylinder 202, 204 to release pressure through the valve system 220.

In some embodiments, a monitor 402 may be provided to visually display pressure information in the pneumatic cylinder 202, 204. In some embodiments, the monitor 402 may be a part of the controller 400. The monitor 402 and the controller 400 can be placed in a location convenient for the user to see. For example, the monitor 402 and controller 400 may be attached to the frame. In the preferred embodiment, the monitor 402 and controller 400 are attached to the frame at one of the junctions where the horizontal frame 102 meets one of the vertical frames 106, 108. This keeps the controller 400 and monitor 402 away from the user to avoid obstructing an exercise. The controller 400 may also have actuators to adjust, i.e. raise or lower, the resistive force in the pneumatic cylinder 202, 204.

In the preferred embodiment, the controller 400 may have a synced mode and an independent mode. In the synced mode, the actuators 358, 360 on both handles 350 control both pneumatic cylinders 202, 204, most simply by connecting both cylinders with a common tank; therefore, both pneumatic cylinders 202, 204 are synced with each other in terms of the amount of pressure in the cylinders 202, 204. Therefore, actuation of the gas input actuator 358 or the gas release actuator 360 on either handle 350 will cause both pneumatic cylinders 202, 204 to adjust accordingly. In the independent mode, each handle 350 only controls the pneumatic cylinders 202, 204 associated with the respective handle 350, which may be accomplished by using separate tanks for each cylinder. Therefore, if the user's non-dominant hand requires less resistive force than the dominant hand, the exercise system 100 can accommodate such features. This may also be useful for physical therapy one arm that has been injured.

In some embodiments, the exercise system 100 may comprise a strain gauge 156 (or load cell). A strain gauge 156 may be used to measure the pulling force imparted by the user while the pneumatic cylinders 202, 204 are locked in place. This information can be used to help the user determine the amount of resistive force desired for a particular exercise. For example, the user may stand in front of the frame with one handle in his left hand outstretched to the left and one handle in his right hand outstretched to the right. With the pneumatic cylinders 202, 204 locked in place, the user can use as much force as he wants to bring the two handles 350 together in front of his chest. Since the pneumatic cylinders 202, 204 are locked in place, the strain gauge measure e ling force being imparted by the user during this motion. If the user uses all his strength, this will be his maximum pulling force for this type of exercise. This maximum pulling force may be automatically inputted into the controller. The user can then set the controller to provide a specific percentage, for example 70 percent, of the maximum pulling force as the resistive force in the pneumatic cylinder 202, 204. The user can then perform this exercise with a resistive force being equivalent to about 70 percent of the user's maximum pulling force.

Figure 10:
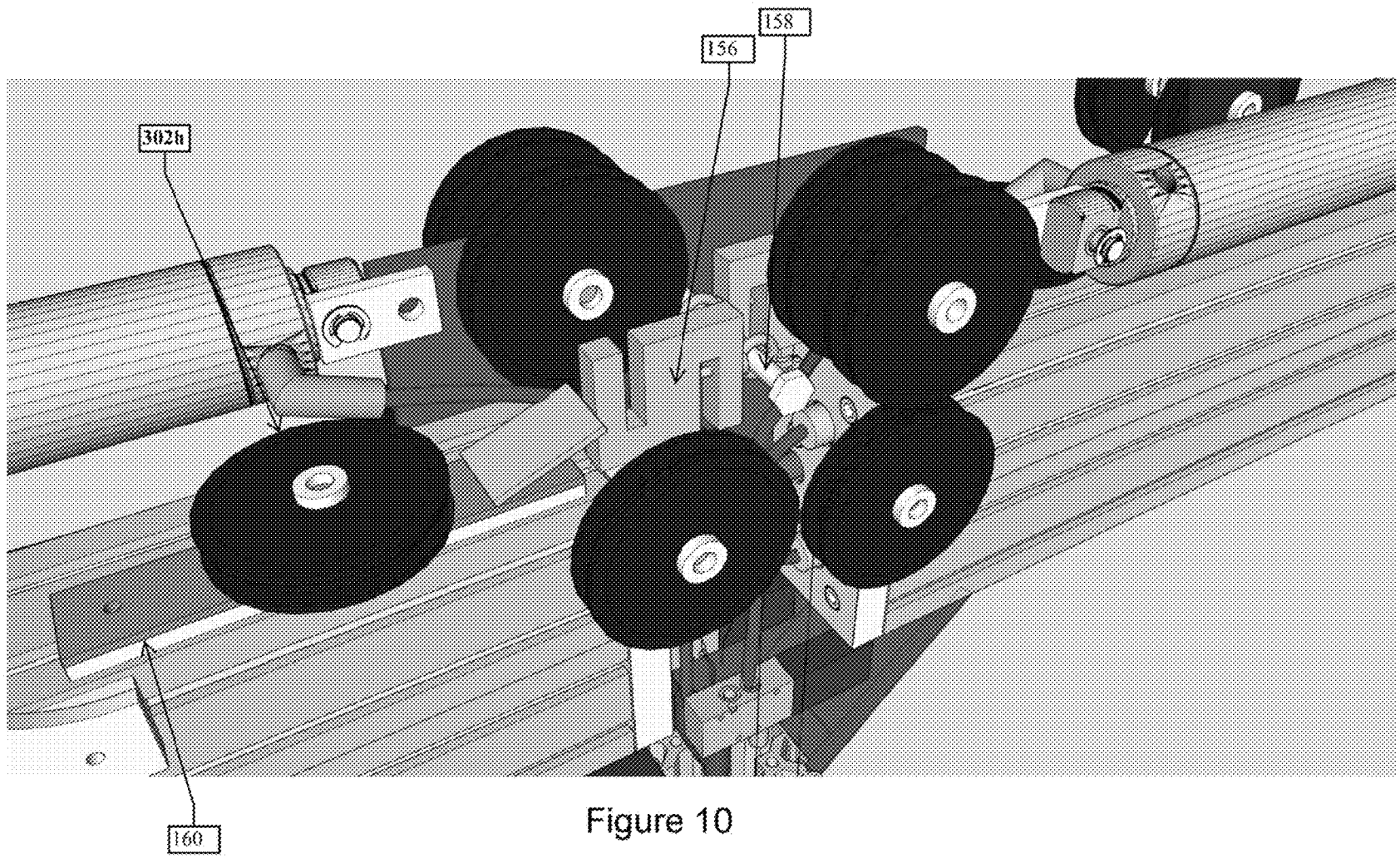
FIG. 10 shows a partial view of an embodiment of the invention showing the strain gauge.

In the preferred embodiment, the user can activate the strain gauge 156 and lock the pneumatic cylinder 202, 204 by depressing both the gas input actuator 358 and the gas release actuator 360 simultaneously. Various other activation modes may be employed. As shown in FIG. 10, in the preferred embodiment, one side of the strain gauge 156 is fixed to a corner plate 112 by a bolt 158 or some other fastening mechanism. The other side of the strain gauge 156 is attached to a pulley **302*h* mounted on a slide plate 160. When the pneumatic cylinders are locked the force exerted by the user when moving the handles 350 are imposed on the strain gauge 156. That force is converted to an electrical signal that can be recorded as the amount of force exerted on the strain gauge 156**.

A variety of accessories can be attached to the frame to offer a wider variety of exercises that can be performed on the frame. For example, the frame may further comprise a chin-up bar 500, a dip station, straps, ropes, bands, and the like. Suspension devices, such as the straps, ropes, and bands are usually left dangling, which can interfere with a user maneuvering around the station. Therefore, the suspension devices may be made to retract into a housing. For example, the suspension devices may be attached to a spring wrapped around a post inside the housing. As the suspension device is pulled out for use, the spring tightens around the post. When the user has completed the exercise and releases the suspension device, the spring unwinds and retracts the suspension device back into the housing.

In use, the user grasps a first handle 350 having a first resistance adjustor (e.g. the gas input actuator 358) so that a first digit of the user (e.g. the thumb) is proximal to the first resistance adjustor so that the user can actuate the first resistance adjustor with the first digit without adjusting the user's grasp of the first handle 350. The first handle 350 and the first resistance adjustor are operatively connected to a resistance machine 200. The user grasps a second handle having a second resistance adjustor (e.g. the gas release actuator 360) so that a second digit of the user (e.g. the user's other thumb) is pro al to the second resistance adjustor so that the user can actuate the second resistance adjustor with the second digit without adjusting the user's grasp of the second handle. The second handle and the second resistance adjustor are operatively connected to the resistance machine 200. The user moves the first and second handles 350 (e.g. pushing motion or pulling motion) until the resistance machine 200 imparts a resistive force against such movement. The resistive force can be overcome by the user by moving the first and second handles 350 with greater force. If the user wants to change the amount of resistive force, the user can adjust the resistive force of the resistance machine 200 through a controller 400 by actuating the first resistance adjustor or the second resistance adjustor with the first or second digits, respectively, without having to alter the grasp on the first and second handles 350. By way of example only, actuating the first resistance adjustor may increase the resistive force of the resistance machine 200, and actuating the second resistance adjustor may decrease the resistive force of the resistance machine 200.

In some embodiments, actuating the gas input actuator 358 and the gas release actuator 360 simultaneously locks the resistance machine 200 and activates a strain gauge to measure an amount of pulling force applied to the resistance machine 200 by the user. The amount of force recorded by the strain gauge may be used to determine the resistive force or some percentage thereof.

Thus far, only a single station of the exercise system 100 has been described. The structural features described above can be replicated to create multiple stations **100*a*, 100*b* in a single gym setting. Each station may comprise a separate pair of pneumatic cylinders 202, 204 that may have a common tank or separate tanks, a separate pulley system 300, and separate handles 350, 352. In some embodiments, each station 100*a*, 100*b* may have its own gas compressor 214. In some embodiments, a single gas compressor 214** may provide compressed gas for multiple stations.

Figure 9:
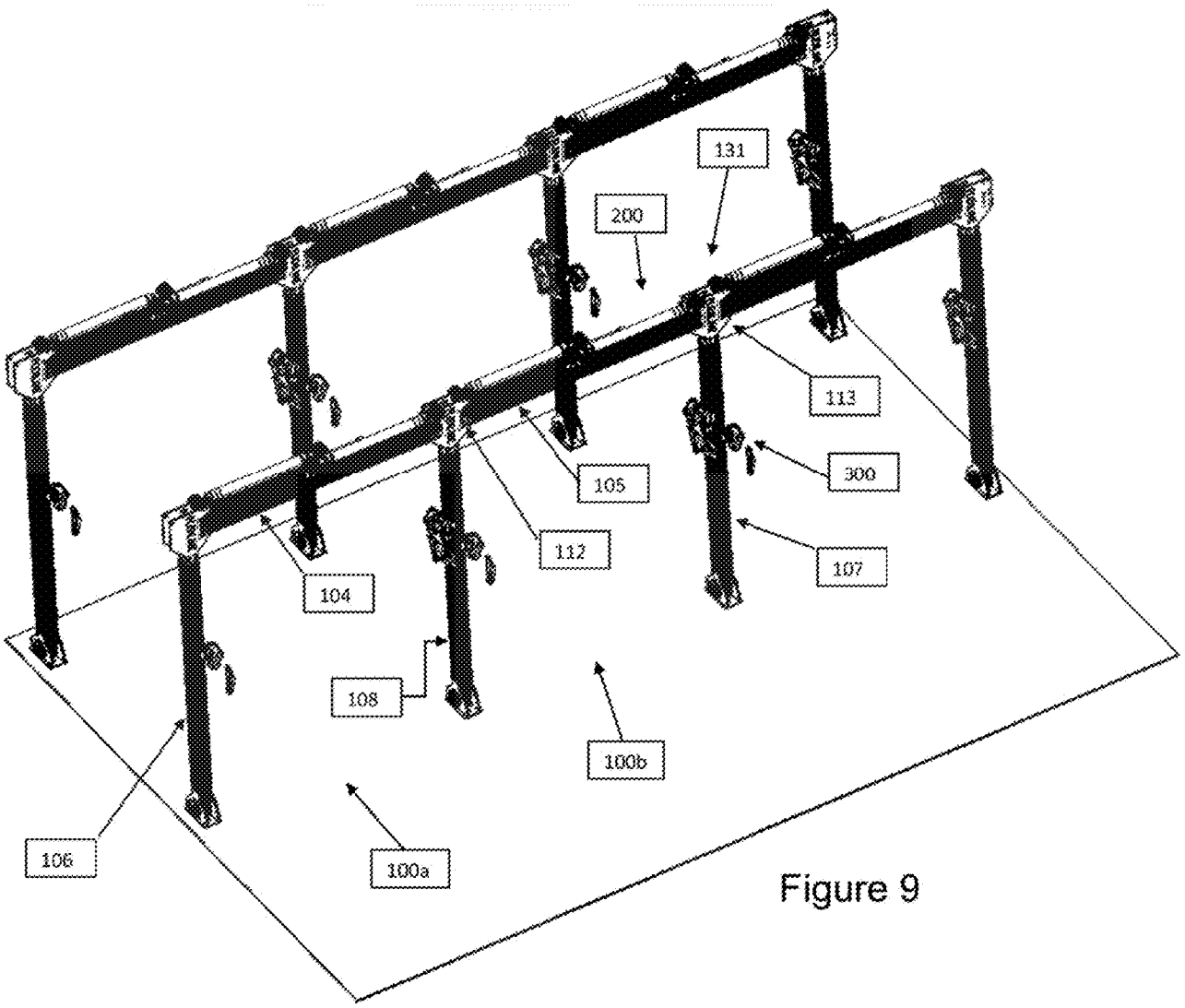
FIG. 9 shows a perspective view of an embodiment of the present invention with multiple exercise stations.

As shown in FIG. 9, the exercise system 100 is designed to be modular so that additional stations can be added quickly and easily, and allow a series of stations to be used simultaneously, either individually or in group exercise class. When adding a second station **100*b* adjacent to a first station 100*a*, the second vertical frame 108 may function as the first vertical frame for the second station 100*b*. A second horizontal frame 105 can be attached to the second corner plate 112 of the first station 100*a*. A third vertical frame 107 is attached to the second end 131 of the second horizontal frame 105 by a third corner plate 113. Thus, the first and second stations 100*a*, 100*b* share a common vertical frame and a common corner plate. The resistance machine 200, pulley system 300, and controller 400 are replicated and attached to the second station 100***b* in the same manner as discussed above. Additional stations can be added in like manner.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

INDUSTRIAL APPLICABILITY

This invention may be industrially applied to the development, manufacture, and use of a compact and efficient exercise system that maximizes exercise floorspace by utilizing a frame having attached to it a pulley system, drive mechanism attached to the pulley system, and a resistance machine preferably in the form of pneumatic cylinders 202, 204 attached to the drive mechanism, and a pair of handles attached to the drive mechanism such that movement of the handles in various directions causes a pulling force on the drive mechanism which causes the piston of the pneumatic cylinders 202, 204 to compress into the gas tube of the pneumatic cylinder, wherein compressed gas in the gas tube imposes a resistive force against the piston decree resistance for the user during an exercise.

What is claimed is:

1. An exercise system, comprising:

a. a frame, comprising:

i. a first vertical frame and a second vertical frame, each vertical frame having a top end and a bottom end; and ii. a horizontal frame having a first side, a second side opposite the first side, a top side adjacent to the first side and the second side, a bottom side opposite the top side and adjacent to the first side and the second side, a first end adjacent to the first side, the second side, the top side, and the bottom side, and a second end opposite the first end and adjacent to the first side, the second side, the top side, and the bottom side, the first end adjacent to the top end of the first vertical frame, and the second end adjacent to the top end of the second vertical frame, the first side comprising a first set of tracks, the second side comprising a second set of tracks, the first side, second side, top side, and bottom side defining a plurality of cavities extending from the first end to the second end of the horizontal frame;

b. a pulley system operatively coupled to the frame, the pulley system comprising:

i. a plurality of pulley wheels, ii. a drive mechanism operatively coupled to the pulley wheels, and iii. a pair of handles operatively coupled to the drive mechanism;

c. a resistance machine operatively coupled to the pair of handles via the drive mechanism, the resistance machine having a resistive force to counter a pulling force on the drive mechanism by a user moving any of the handles; and d. a controller operatively connected to the resistance machine to adjust the resistive force.

2. The exercise system of claim 1, wherein the resistance machine comprises:

a. a first pneumatic cylinder comprising a first gas tube, a first piston slidable within the first gas tube, a first access port, and a first valve system, the first piston operatively connected to a first piston slide plate slidably mounted on the horizontal frame, and the first gas tube operatively connected to a first corner plate mounted on the horizontal frame; and b. a compressor operatively connected to the first pneumatic cylinder to introduce compressed gas into the first pneumatic cylinder via the first access port.

3. The exercise system of claim 2, wherein when the user imparts the pulling force on the cable by moving the first handle, the first piston is driven into the first gas tube as the first sliding bracket moves towards the first corner plate and the compressed gas inside the first gas tube provides the resistive force, wherein the resistive force remains constant by dissipating the compressed gas into an equalizing tank housed in one of the plurality of cavities of the horizontal frame.

4. The exercise system of claim 3, wherein a gas hose and an electrical line are housed in at least one of the plurality of cavities of the horizontal frame, the gas hose providing the compressed gas to the first pneumatic cylinder and the electrical line providing power to the controller.

5. The exercise system of claim 4, wherein the first handle is cylindrical in shape having a first end and a second end opposite the first end, the first end having a first gas input actuator and the second end having a first gas release actuator.

6. The exercise system of claim 5, wherein the controller is operatively connected to the first gas input actuator, the first gas release actuator, the first valve system, and to the compressor, wherein actuation of the first gas input actuator causes the controller to turn the compressor on to increase gas pressure in the first pneumatic cylinder; and wherein actuation of the first gas release actuator causes the first pneumatic cylinder to release pressure through the first valve system.

7. The exercise system of claim 6, wherein the first valve system is controlled by a servomotor.

8. The exercise system of claim 7, further comprising a monitor to visually display pressure information in the first pneumatic cylinder.

9. The exercise system of claim 8, further comprising a strain gauge, wherein actuation of the gas input actuator and the gas release actuator simultaneously locks the resistance machine and allows the strain gauge to measure the pulling force on the cable system by the user.

10. The exercise system of claim 9, further comprising a plurality of exercise stations, each station comprising a separate pair of pneumatic cylinders, a separate pulley system, a separate cable system attached to its respective pulley system, and separate handles, wherein the compressor provides compressed gas for multiple stations.

11. The exercise system of claim 1, wherein the each handle comprises an accelerometer.

12. The exercise system of claim 11, wherein internal components of each handle are contained in a handle cage that is configured to be removed from the handle and inserted into a second exercise device.

13. The exercise system of claim 1, wherein the pneumatic cylinder comprises an infrared sensor to measure a speed of movement of the piston.

14. A method of exercising, comprising:

a. grasping a first handle having a first resistance adjustor so that a first digit of a user is proximal to the first resistance adjustor for actuating the first resistance adjustor with the first digit without adjusting the user's grasp of the first handle, wherein the first handle and the first resistance adjustor are operatively connected to a resistance machine;

b. grasping a second handle having a second resistance adjustor so that a second digit of the user is proximal to the second resistance adjustor for actuating the second resistance adjustor with the second digit without adjusting the user's grasp of the second handle, wherein the second handle and the second resistance adjustor are operatively connected to the resistance machine;

c. moving the first and second handles until the resistance machine imparts a resistive force on the moving step;

d. overcoming the resistive force by moving the first and second handles with greater force; and e. adjusting the resistive force of the resistance machine through a controller by actuating the first resistance adjustor or the second resistance adjustor with the first or second digits, respectively, without having to alter the grasp on the first and second handles, wherein actuating the first resistance adjustor increases the resistive force of the resistance machine, wherein actuating the second resistance adjustor decreases the resistive force of the resistance machine, and wherein actuating the first resistance adjustor and the second resistance adjustor simultaneously locks the resistance machine and activates a strain gauge to measure an amount of force applied to the resistance machine by the user.

15. The method of claim 14, wherein the resistance machine is a pneumatic cylinder.

16. The method of claim 14, further comprising detecting movement of the handles with an accelerometer inside each handle.

17. The method of claim 15, further comprising measuring a pulling force of the pneumatic cylinder by measuring a speed of piston movement.

18. The method of claim 14, wherein the amount of force recorded by the strain gauge is used to determine the resistive force.

* * * * *